US005298873A

United States Patent [19]

Ala-Kojola

[11] Patent Number: 5,298,873

[45] Date of Patent: Mar. 29, 1994

[54] ADJUSTABLE RESONATOR ARRANGEMENT

[75] Inventor: Jouni Ala-Kojola, Oulu, Finland

[73] Assignee: Lk-Products Oy, Kempele, Finland

[21] Appl. No.: 906,217

[22] Filed: Jun. 25, 1992

[30] Foreign Application Priority Data

Jun. 25, 1991 [FI] Finland ..... 913088

[51] Int. Cl.[5] ..... H01P 7/00

[52] U.S. Cl. ..... 333/235; 333/202; 333/223

[58] Field of Search ..... 333/235, 205, 202, 206, 333/223

[56] References Cited

U.S. PATENT DOCUMENTS

| | | | |
|---|---|---|---|
| 3,202,945 | 8/1965 | Tachizawa et al. | 333/235 |
| 3,766,494 | 10/1973 | Anbe et al. | 333/235 |
| 4,028,652 | 6/1977 | Wakino et al. | 333/73 W |
| 4,255,729 | 3/1981 | Fukasawa et al. | 333/202 |
| 4,431,977 | 2/1984 | Sokola et al. | 333/206 |
| 4,434,410 | 2/1984 | Miyake et al. | 333/224 |
| 4,559,508 | 12/1985 | Nishikawa et al. | 333/202 |
| 4,623,856 | 11/1986 | Bickley et al. | 333/205 |
| 4,692,726 | 9/1987 | Green et al. | 333/206 |
| 4,703,291 | 10/1987 | Nishikawa et al. | 333/202 |
| 4,716,391 | 12/1987 | Moutrie et al. | 333/206 |
| 4,740,765 | 4/1988 | Ishikawa et al. | 333/206 |
| 4,800,347 | 1/1989 | Yorita et al. | 333/202 |
| 4,800,348 | 1/1989 | Rosar et al. | 333/202 |
| 4,821,006 | 4/1989 | Ishikawa et al. | 333/202 |
| 4,829,274 | 5/1989 | Green et al. | 333/202 |
| 4,835,498 | 5/1989 | Rouger et al. | 333/205 |
| 4,954,796 | 9/1990 | Green et al. | 333/206 |
| 4,992,737 | 2/1991 | Schnur | 333/235 |
| 5,049,842 | 9/1991 | Ishikawa et al. | 333/235 |
| 5,066,934 | 11/1991 | Ito et al. | 333/205 |
| 5,075,653 | 12/1991 | Ito et al. | 333/205 |
| 5,103,197 | 4/1992 | Turunen et al. | 333/206 |

FOREIGN PATENT DOCUMENTS

| | | | |
|---|---|---|---|
| 0208424 | 1/1987 | European Pat. Off. | 333/235 |
| 0296009 | 12/1988 | European Pat. Off. | 333/205 |
| 0401839 | 12/1990 | European Pat. Off. | 333/235 |
| 2438937 | 5/1980 | France | 333/205 |
| 2622054 | 4/1989 | France | 333/235 |
| 114503 | 7/1983 | Japan | 333/235 |
| 101902 | 5/1984 | Japan | 333/235 |
| 161806 | 7/1986 | Japan | 333/235 |
| 312701 | 12/1988 | Japan | 333/235 |
| 94901 | 4/1990 | Japan | 333/235 |
| 2060294 | 4/1981 | United Kingdom | 333/235 |
| 2184608 | 6/1987 | United Kingdom | 333/235 |
| 2234398 | 1/1991 | United Kingdom | 333/235 |
| 2234399 | 1/1991 | United Kingdom | 333/235 |
| 2236432 | 4/1991 | United Kingdom | 333/235 |

OTHER PUBLICATIONS

Patent Abstracts of Japan—vol. 7, No. 292 (E-219)(1437) Dec. 27, 1983 & JP-A-58-168 302 (Fujitsu K.K.) Oct. 4, 1983.

Patent Abstracts of Japan—vol. 5, No. 11 (E-42)(683) Jan. 23, 1981 & JP-A-55 141 802 (Alps Denki K.K.) Nov. 6, 1980.

Patent Abstracts of Japan—vol. 12, No. 106 (E-596)(2953) Apr. 6, 1988 & JP-A-62 235 801 (Fuji Electrochem Co., Ltd.) Oct. 16, 1987.

*Primary Examiner*—Raymond A. Nelli

*Attorney, Agent, or Firm*—Darby & Darby

[57] ABSTRACT

An adjustable resonator arrangement comprises a main resonator (T1) and a secondary resonator (T2) reactively coupled thereto. The secondary resonator includes a switching element (S), e.g. a varactor, having at least two states. When the switching element is in a first state the secondary resonator behaves as a half-wave resonator having a resonant frequency $f_o$ substantially different to the resonant frequency f of the main resonator. Consequently the secondary resonator has no appreciable affect on the resonant frequency of the main resonator. However, when the switching element is in a second state, the secondary resonator behaves as a quarter-wave resonator having a resonant frequency $2*f_o$ which is closer to the inherent frequency f of the main resonator and sufficiently close to cause a shift Δf in the effective frequency of the main resonator. Suitably the main resonator is realized as a dielectric resonator and the secondary resonator is realized as a strip line resonator in the form of a conductive strip provided on a side face of the dielectric block from which the main resonator is formed.

29 Claims, 6 Drawing Sheets

ADJUSTABLE RESONATOR ARRANGEMENT

Figure 1:
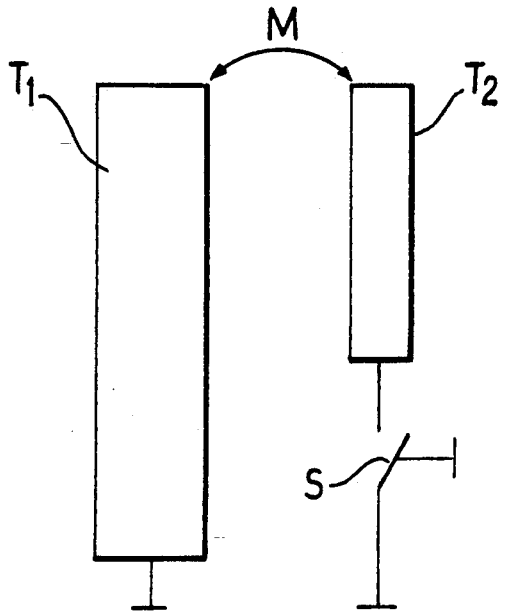

The present invention relates to an adjustable resonator arrangement wherein the resonant frequency can be varied, and further relates to a tunable multi-resonator filter comprising at least one such adjustable resonator arrangement.

It is known in the high-frequency art to use resonators of different types for different applications depending on the conditions of use and the desired characteristics. Known resonator types include dielectric, helical, strip line (including microstrip), and air isolated rod resonators. These various resonator types each have a relevant range of uses. For example, dielectric resonators and filters constructed therefrom are commonly used, e.g. in radiotelephone applications, because of their relatively small size and weight, stability and power endurance. The individual resonators are in the form of a transmission line resonator corresponding to a parallel connection of inductance and capacitance. A filter having the desired properties can be realised by the appropriate interconnection of a number of such resonators. For instance, a dielectric filter may be constructed from discrete dielectric blocks, wherein an individual resonator is formed in each block, or from a single monolithic block having several resonators formed in a common dielectric body.

It is desirable in some filter applications to be able to shift the filter characteristic (i.e. the attenuation curve of the filter) to a higher or lower frequency without altering the shape of the curve as far as possible. If the centre frequency of the filter can be adjusted between a higher and a lower value, one adjustable filter may be used in place of two fixed filters.

It is known in the art that RF filters may be provided with adjustment means such as adjusting screws, which can be turned manually to alter the capacitative load at the open end of the resonators or to alter the inductive coupling between resonators. The individual resonators are tuned using the adjusting screws to obtain the desired resonant frequency and then no further adjustments are generally made.

It is also known to automate the movement of the mechanical adjustment means. For example, in a filter based on helical resonators, a stepper motor may be used to move an element within the electromagnetic field and so vary the capacitative or inductive coupling. The element may be a rod or a ring movable within or around the helical coil, or a movable tab or plate-like member provided at the open end of the coil.

In the case of a dielectric resonator, it is known to include a variable capacitance diode at the open-circuit end of the resonator or within the resonator hole. Thus the capacitive load and hence the resonant frequency can be controlled. Such electrically controllable resonators have the drawback that they tend to increase the insertion loss, which is a disadvantage because the transmission attenuation is also increased in the bandpass region. Moreover, the use of a variable capacitance diode may impose limitations on the power and voltage endurance. Also, in practice the variable capacitance diode is generally located at an area where the field intensity of the resonator is greatest, which may adversely affect the coupling. Furthermore electrically adjustable filter arrangements known in the art tend to be relatively difficult to manufacture.

European patent application EP-A-0,472,319 discloses a tunable filter comprising two or more reactively coupled dielectric resonators having voltage controlled tuning means, e.g. a varactor, coupled in parallel to the open circuit end of each of the resonators respectively. The center frequency of the filter can be shifted by varying the voltage applied to the tuning means.

U.S. Pat. No. 4,186,359 discloses a notch filter network comprising an LC parallel resonance circuit implemented with discrete components in series with a transmission line. The inductance is movably mounted within a cavity resonator whose resonant frequency differs from that of the LC circuit. The coupling between the inductance can be varied by moving the inductance within the cavity resonator causing a change in the overall performance characteristic.

According to a first aspect of the present invention there is provided an adjustable resonator arrangement comprising a primary resonator, and a secondary resonator disposed within the electromagnetic field of the primary resonator to provide electrical signal coupling therebetween, the secondary resonator having at least two selectable states, wherein in a first state the secondary resonator has a first resonant frequency, and in a second state the secondary resonator has a second resonant frequency which is nearer to the resonant frequency of the primary resonator than said first resonant frequency, thereby causing a change in the effective resonant frequency of the primary resonator.

In a resonator arrangement in accordance with the invention the extent to which the secondary resonator influences the resonant frequency of the primary resonator depends both on the resonant frequency of the secondary resonator and on the intensity of the coupling between the secondary and the primary resonators. The intensity of the coupling is affected by the structure of the primary resonator and the location of the secondary resonator relative to the primary resonator. Hence the degree of adjustment (frequency shift) can be controlled according to the particular application by suitable choice of the resonant frequency of the secondary resonator and the degree of coupling.

Suitably, the first resonant frequency of the secondary resonator is so different from the resonant frequency of the primary resonator that it has no appreciable effect thereon.

In a particular embodiment the secondary resonator includes adjustment means such as a pin-diode or a varactor for selecting the two states thereof, and means for applying a control signal to said adjustment means, wherein the state of said secondary resonator is determined by the adjustment means in response to the control signal applied thereto.

In one state the secondary resonator may correspond to a half-wave resonator, and in another state the secondary resonator may correspond to a quarter-wave resonator. This is the case, for example, when a pin-diode is used as the adjustment means. In a particular example the first resonant frequency of the secondary resonator may be substantially higher than the resonant frequency of the primary resonator and the effective resonant frequency of the primary resonator is lowered when the secondary resonator is in the state corresponding to a quarter-wave resonator.

A resonator in accordance with the invention is particularly suited for realization as a dielectric resonator, more especially of the type formed from a dielectric block having an electrode pattern provided on a side face to allow coupling to the resonator and, in the case of multiple resonators, between adjacent resonators. Such a resonator configuration is disclosed in European patent application EP-A-0,401,839 and corresponding U.S. Pat. No. 5,103,197.

Therefore, according to a second aspect of the invention, there is provided a resonator device comprising a body of dielectric material having upper and lower surfaces, two side surfaces, two end surfaces, and a hole extending from said upper surface towards said lower surface; an electrically conductive layer covering major portions of the lower surface, one side face, both end faces and the surface of said hole thereby forming a main transmission line resonator; an electrode pattern disposed on the other side surface for providing electric signal coupling to and from the main resonator; and an electrically conductive strip disposed on said other side surface forming a secondary transmission line resonator.

The electrode pattern may be made with the aid of a mask directly on said one side surface of the dielectric block and the same mask may be used for simultaneously producing the secondary strip line resonator on the same side surface as the electrode pattern. The length of the strip line is selected according to the required resonant frequency.

In a preferred embodiment, means for adjusting the resonant frequency of the secondary resonator are provided on the same side surface of the dielectric block as the electrode pattern and the strip line resonator.

According to a further aspect of the invention there is provided a filter including a plurality of resonators wherein at least one of the resonators is an adjustable resonator in accordance with the first or second aspects of the invention. In the case of a dielectric multi-resonator filter each of the resonators may be formed respectively from a discrete body of dielectric material. Alternatively, some or all the resonators may be formed in a common body of dielectric material.

Figure 2:
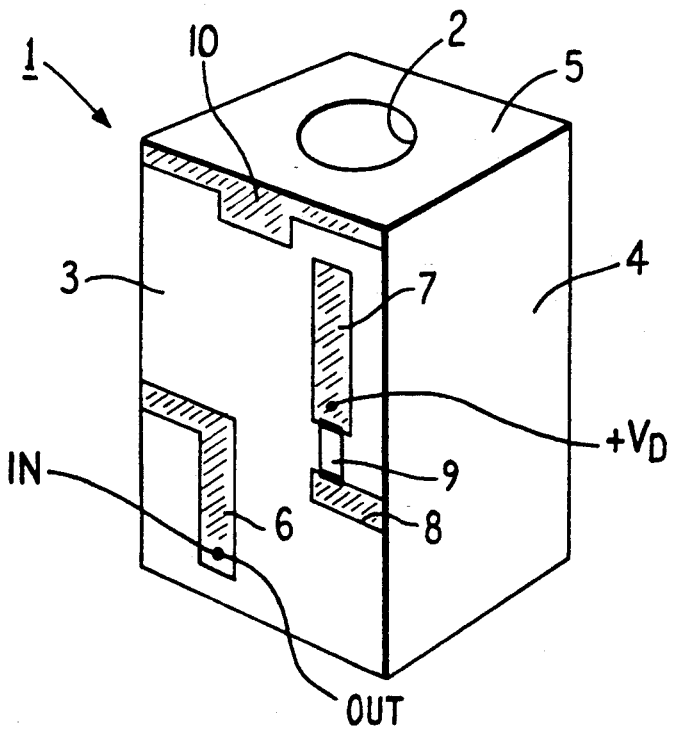
Figure 3A:
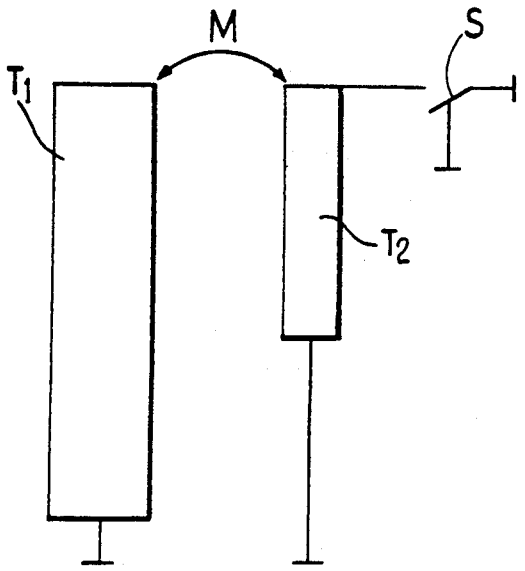
Figure 3B:
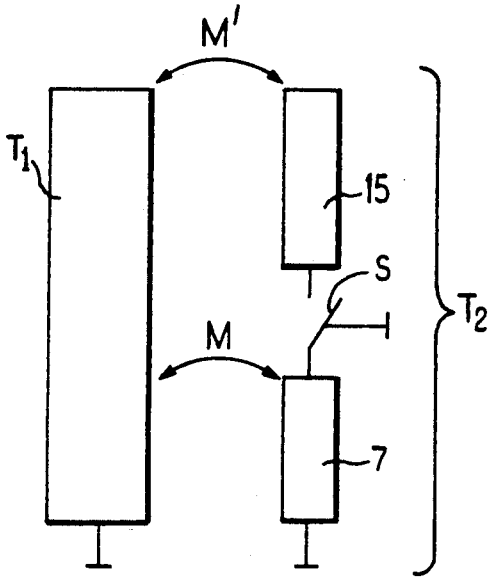
Figure 4:
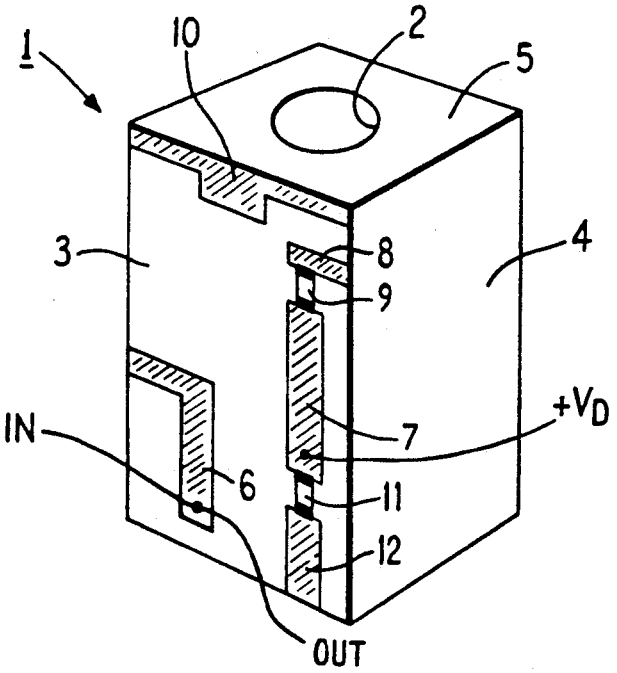
Figure 5:
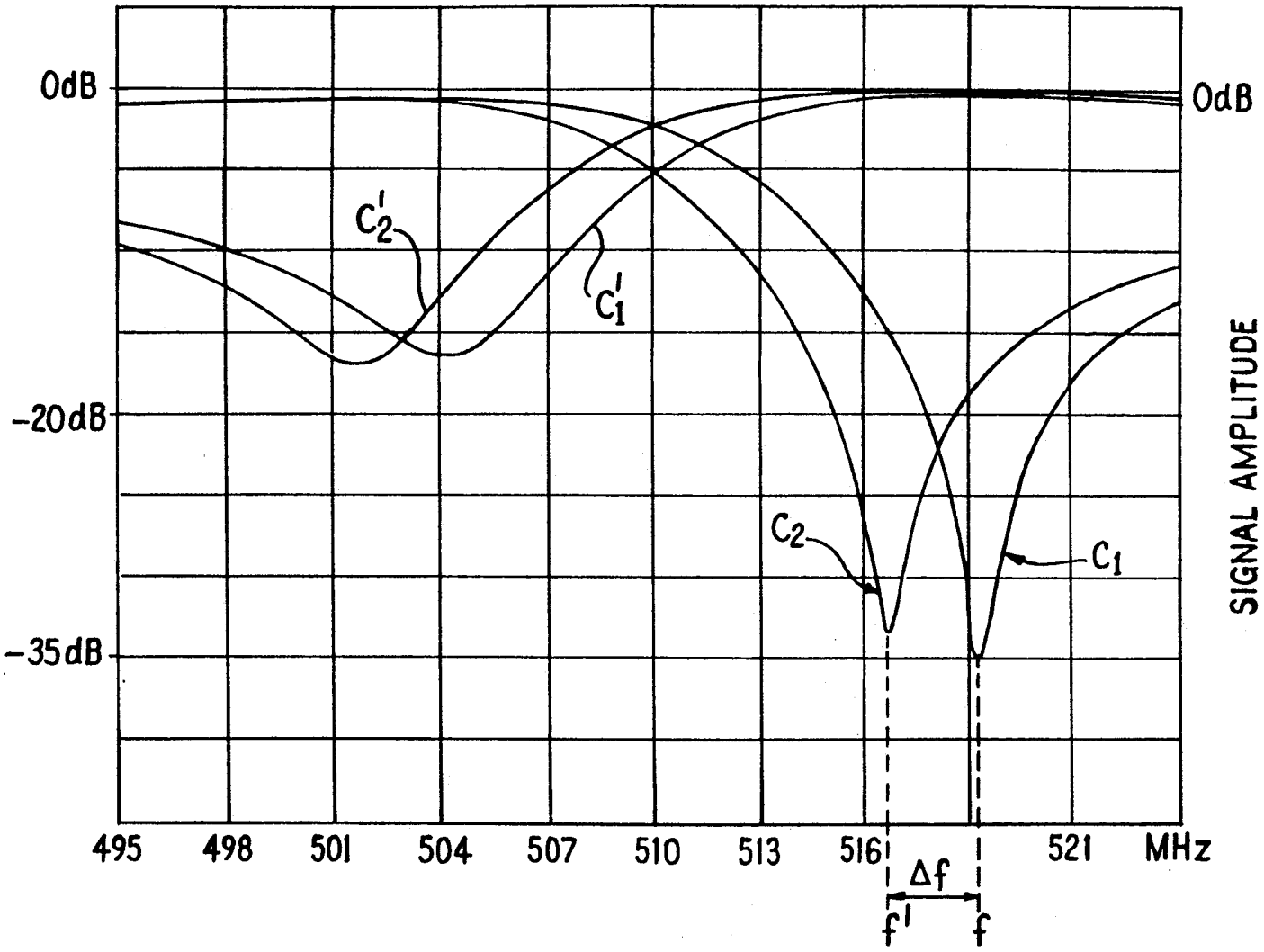
Figure 6:
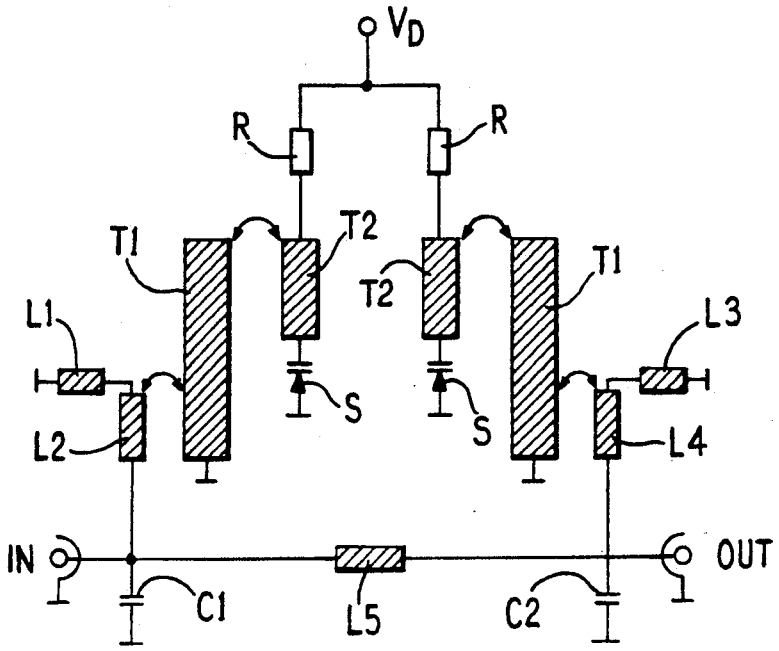
Figure 7:
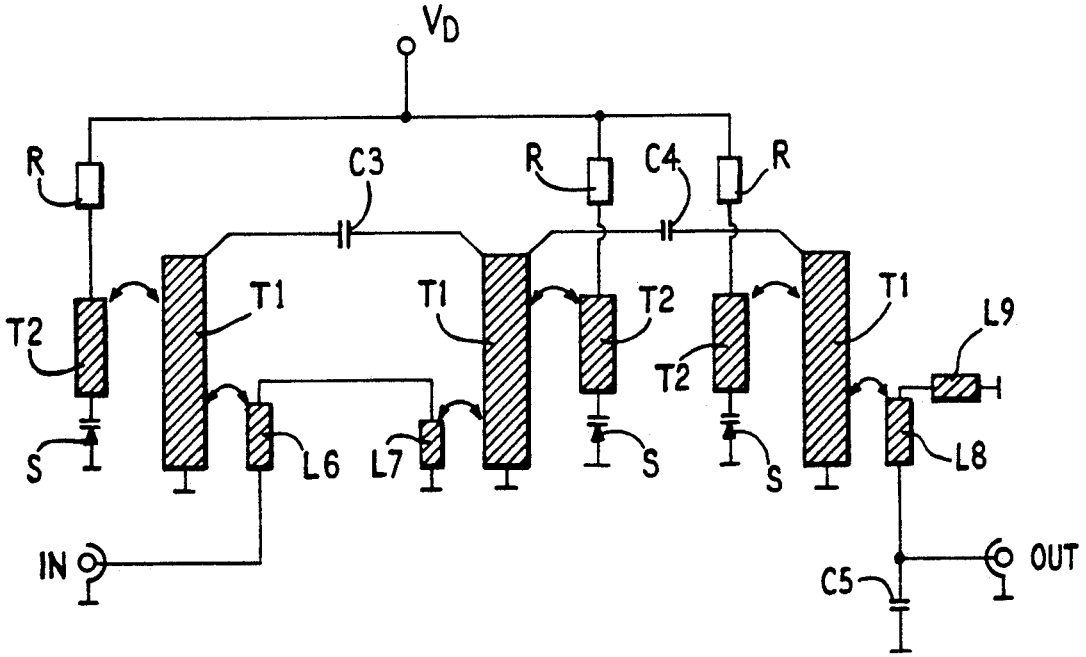
Figure 8:
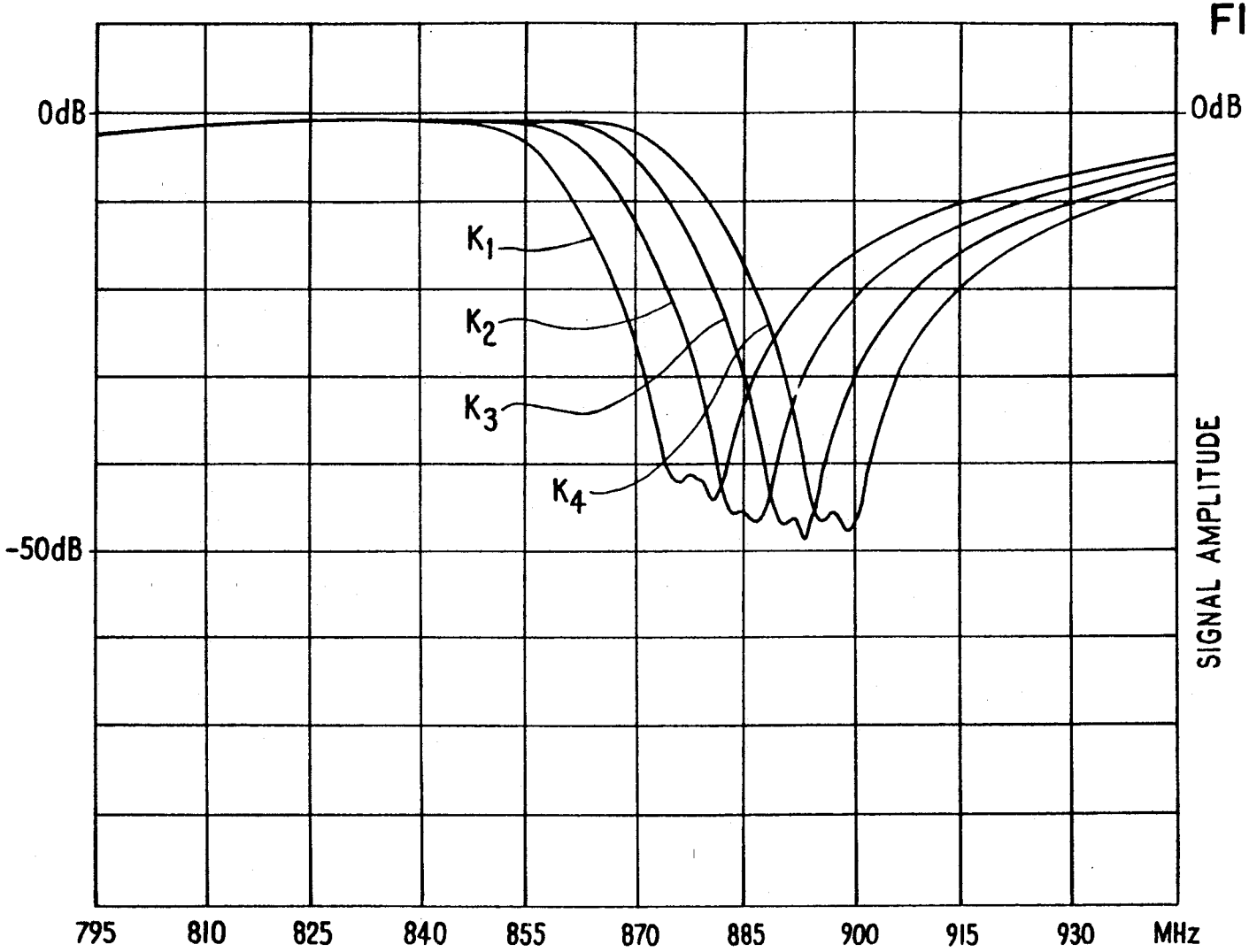
Figure 9:
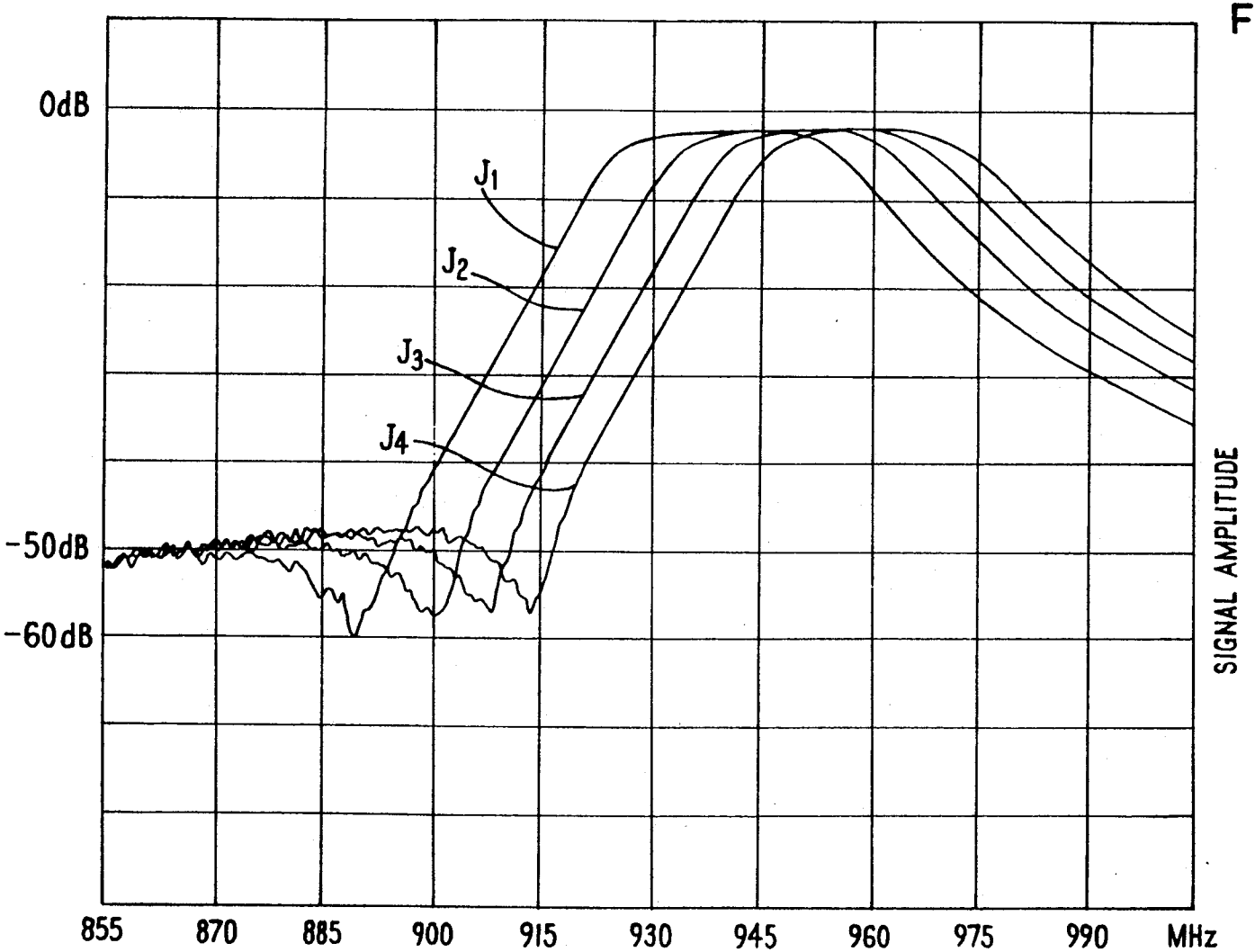

Embodiments of the invention will now be described, by way of example, with reference to the accompanying drawings, in which:

FIG. 1 is schematic diagram of a first resonator arrangement in accordance with the invention, FIG. 2 is a perspective view of a dielectric resonator configuration implementing the resonator arrangement of FIG. 1, FIG. 3A is a schematic diagram of a different resonator arrangement in accordance with the invention, FIG. 3B is a schematic diagram of a further resonator arrangement in accordance with the invention, FIG. 4 is a perspective view of a dielectric resonator configuration implementing the resonator arrangement of FIG. 3, FIG. 5 is a graph showing the frequency response of the resonators in FIG. 2 and FIG. 4, FIG. 6 is a schematic block diagram of a bandstop filter in accordance with the invention, FIG. 7 is a graph showing the frequency response of the bandstop filter in FIG. 6, FIG. 8 is a schematic block diagram of a bandpass filter in accordance with the invention, and FIG. 9 is a graph showing the frequency response of the bandpass filter in FIG. 8.

The resonator shown in FIG. 1 comprises a main resonator T1 which can be a resonator of any suitable type known in the art, such as a helical, coaxial, dielectric or strip line resonator. One end of the main resonator (the upper end in FIG. 1) is open-circuited and the other end is short circuited to ground potential. The resonator T1 has an inherent resonant frequency f. A secondary resonator T2, suitably implemented as a strip line resonator, is provided within the electromagnetic field of the main resonator T1. The secondary resonator is open-circuited at its upper end, and the lower end is short-circuited to ground potential via a switching element S. A reactive coupling M exerts an influence between the two resonators T1 and T2.

The secondary resonator T2 has two states, corresponding respectively with the situation when the switching element S is open and when it is closed. When the switching element is open, the secondary resonator T2 acts as a half-wave resonator having a resonant frequency $f_0$. The dimensions of the strip constituting the strip line resonator are chosen so that its resonant frequency $f_0$ is so much higher than the inherent resonant frequency f of the main resonator T1 that it has virtually no affect on the resonant frequency of the main resonator. After closing the switching element S, the lower end of the secondary resonator will be short-circuited, whereby it acts as a quarter-wave resonator with a resonant frequency of $f_0/2$, which is closer, but still higher than f. The resonant frequency $f_0/2$ is now sufficiently close to the inherent resonant frequency f of the main resonator that the coupling M causes the effective resonant frequency of the main resonator T1 to shift downwards by an amount $\Delta f$ to a new resonant frequency f'. The magnitude of this frequency shift $\Delta f$ can be altered as desired by appropriate selection of the values for the resonant frequency $f_0$ of the secondary resonator and the coupling M. As mentioned previously, the coupling M is dependant on the mutual disposition of the primary and secondary resonators.

FIG. 2 shows how the resonator arrangement in FIG. 1 may be implemented as a dielectric resonator 1. The resonator is formed from a rectangular dielectric block having a hole 2 extending from the upper face 5 to the lower face of the block. All faces except the upper face, or at least part of it around the hole 2 and the side face 3, are coated with an electrically conductive material which in practice is coupled to ground potential. The non-coated side face 3 is provided with a conductive pattern, including an L-shaped strip 6 forming an orthogonal pair of transmission lines which behave as a notch filter. The horizontal limb of the L-shaped strip is coupled to the conductive material on the end face of the block adjacent the side face 3, and a common input/output point IN/OUT is present at the remote end of the vertical limb of the L-shaped strip 6. The upper edge of the side face 3 is also provided with a horizontal conductive strip 10 extending to the conductive coating on the two opposite end faces, and having an enlarged central portion. This conductive area 10 serves as a capacitative load for the main dielectric resonator. The dielectric coaxial resonator thus formed has a resonant frequency f.

In accordance with the present invention, a secondary resonator is provided in the form of a conductive strip 7 constituting a strip line resonator. The conductive strip 7 and a contact electrode 8 which is coupled to the conductive coating on the end face 4, are provided as part of the conductive pattern on the same side face 3 on which the input/output coupling strip 6 is provided.

A pin-diode 9 is connected between the lower edge of the strip line 7 and the contact electrode 8. When the diode 9 is non-conductive, i.e. no voltage is applied to the terminal connected to strip line, the strip line 7 acts as a half-wave resonator with a resonant frequency $f_0$ significantly higher than the inherent resonant frequency f of the dielectric resonator 1. With the secondary resonator 7 in this state the resonant frequency of the main dielectric resonator 1 is not affected thereby, as shown by the characteristic curve $C_1$ in FIG. 5.

When the diode 9 is made conductive by applying a positive direct voltage $V_D$ to the strip line, it short-circuits the lower end of the strip line 7 which therefore acts as a quarter-wave resonator. The resonant frequency of the strip line resonator is now much closer to that of the main resonator. This together with the coupling which occurs via the dielectric material causes the characteristic curve of the main resonator 1 to be shifted downwards by an amount $\Delta f$ resulting in the new curve $C_2$ and the resonant frequency of the main resonator is now f', see FIG. 5. As shown in the exemplary curves in FIG. 5, the resulting frequency shift $\Delta f$ is approximately 2.8 MHz, i.e. from an initial resonant frequency f of approximately 519.3 MHz to an adjusted value f' of approximately 516.5 MHz.

The curves $C_1'$ and $C_2'$ in FIG. 5 illustrate the matching of the resonator with the secondary resonator in the first (non-adjusted) state and the second (adjusted) state respectively.

A second embodiment of a resonator arrangement in accordance with the invention is shown in FIG. 3A. The same reference numerals as before are used for the corresponding parts. This arrangement differs from the previous embodiment in that the secondary resonator T2 is permanently short-circuited at one end, at the lower end in this case, and a switching element S is provided between the other end and ground potential. When the switch is open, the secondary resonator T2 acts as a quarter-wave resonator having a resonant frequency $f_0$. The length of the strip line T2 is chosen such that $f_0$ is sufficiently close to the inherent resonant frequency f of the main resonator T1 that the effective resonant frequency becomes f' which is lower than f. When the switching element S is closed, the strip line resonator T2 is converted to a half-wave resonator with a resonant frequency of $2*f_0$, which is at such distance from the resonant frequency f of the main resonator T1 that the effective resonant frequency of the main resonator is unchanged (i.e.=f). This has the effect of increasing the resonant frequency by an amount $\Delta f$ from f' to f.

FIG. 4 shows how the resonator arrangement in FIG. 3A may be implemented as a dielectric resonator. The same reference numerals used in FIG. 2 are again used for corresponding parts in FIG. 4. As in the first embodiment a conductive electrode pattern is provided on the side face 3 of the dielectric block. A strip line resonator 7 is provided as before, but in this case the pin-diode 9 and the contact electrode 8 are present at the upper end of the strip 7. At the lower end of the strip line 7 there is provided an additional vertical electrode contact strip 12 which extends to the bottom face of the dielectric block and is electrically connected to the conductive coating thereon. A capacitor 11 is connected between the lower end of the strip 7 and the electrode 12. The capacitance of the capacitor 11 is high and its function is to prevent a path to ground for the control voltage $V_D$ applied to the strip 7. The capacitor 12 appears as a short-circuit to the radio frequency signal. When the control voltage $V_D=0V$, the diode 9 at the upper end of the strip is non-conductive, whereby the strip line 7 behaves as a quarter-wave resonator, its frequency $f_0$ being relatively close to the frequency f of the main dielectric resonator. This together with the effect of the inter-resonator coupling M causes the effective resonant frequency to become $f'=f-\Delta f$, see attenuation curve $C_2$ in FIG. 5. When a direct voltage $V_D$ is applied to the strip line 7, the diode 9 becomes conductive and connects the upper end of the strip 7 via the contact electrode 8 to ground potential. The strip line 7 now behaves as a half wave resonator with a resonant frequency of $2*f_0$, this being significantly higher than the frequency f of the main resonator, and as a result, the resonant frequency of the main resonator effectively increases by an amount $\Delta f$ to f, which is in fact the inherent (unadjusted) resonant frequency of the main resonator. The corresponding attenuation curve $C_1$ has thus been shifted upwards, as shown in FIG. 5.

In view of the foregoing description it will be evident to a person skilled in the art that other resonator arrangements may be made within the scope of the present invention. For example a reactive load may be provided at the opposite end of the secondary resonator from the switching element, in order to set the frequency of the secondary resonator at a desired level. Using an appropriate load the resonant frequency of the secondary resonator can be positioned below the resonant frequency of the main resonator. In this case the frequency shift $\Delta f$ may be positive between the non-adjusted and adjusted values, i.e. the adjusted value may be greater than the inherent resonant frequency of the main resonator.

In another embodiment, shown schematically in FIG. 3B, one end of the strip line 7 may be connected to ground potential and the other end may be connected via a switching element S to a conductive strip 15 having an open circuit at its opposite end. In this way, not only the resonant frequency of the secondary resonator T2, but also the coupling between the secondary resonator and the main resonator can assume two different values M, M' depending on the switch positions. Consequently, the effective resonant frequency of the main resonator will again have two different values, but in this case there will be a contribution not only from the different resonant frequencies of the secondary resonator, but also the different levels of coupling M, M'.

Furthermore, the size and location of the strip line resonator on the side face of the dielectric resonator can be selected according to the frequency and coupling requirements. Moreover, an element other than a diode may be used as the switching element. Also, the switching element may be provided externally or remotely from the main resonator in which case a conductive lead connected to the secondary resonator may be used to make the external connection to the switching means.

It is not necessary for the secondary resonator to be provided on an integral part of the main resonator as in the case of the dielectric block filter described above. Alternatively the secondary resonator may be supported on a separate insulating plate. For example in the case of a helical main resonator a secondary helical resonator may be supported on an insulating plate adjacent the main helix. Such an insulating plate may also be used in the context of a dielectric filter.

An electrically controllable resonator in accordance with the invention offers a number of advantages in comparison with known resonators. For example, the secondary resonator can be very small in size and is preferably realized as a strip line. The overall resonator arrangement can thus be very compact since the components used for adjustment need not occupy extra space in the main resonator structure, so that the size of the resonator filter can be smaller than its prior art counterparts. The electrical properties of the resonator can be altered by appropriate design and if a variable-capacitance diode (varactor) is used for the switching element, the characteristic curve can be shifted continuously or incrementally over a certain range depending on the applied voltage. Also, the number of the resonators used in a multi-pole filter may be reduced because a wider band of filtering may be achieved with these resonators. This means not only a saving in material but also a smaller, lighter filter.

It is noted here that resonator arrangements in accordance with the invention may be combined in various ways to form tunable filters having different frequency responses.

For example there is shown in FIG. 6 a 2-pole tunable bandstop filter comprising a pair of similar inductively inter-coupled resonator arrangements analagous to those described above with reference to FIGS. 1 and 2. In this case the switching element S coupled between the lower end of the secondary resonator T2 and ground potential is a respective varactor. The upper end of each secondary resonator T2 is coupled via a respective 100 kohm resistor R to a common point at which a control voltage $V_D$ may be applied. The input signal is coupled into the lefthand main resonator T1 by means of an L-shaped pair of strips L1,L2 forming an orthogonal pair of transmission lines in a similar manner to the FIG. 2 embodiment. Likewise, the signal output terminal is coupled to the righthand main resonator T1 by means of an L-shaped pair of strips L3,L4 also forming an orthogonal pair of transmission lines. The two pairs of orthogonal transmission lines L1,L2 and L3,L4 have a notch effect which influences the overall shape of the filter characteristic. Also, respective capacitors C1 and C2, typically having a value of 3pF, are coupled between the lower end of the strips L2 and L4 respectively and ground potential. The lower ends of the strips L2 and L4 are also intercoupled by a transmission line strip L5 which provides inductive coupling between the resonator arrangements. The capacitors C1 and C2 together with the strip L5 help to provide additional low pass filtering.

The characteristic curves for this 2-pole bandstop filter are shown in FIG. 7, wherein the curves $K_1,K_2,K_3,K_4$ correspond with a control voltage $V_D$ of 1V,2V,3V and 4V respectively.

In FIG. 8 there is shown a 3-pole tunable bandpass filter comprising three inter-coupled resonator arrangements of the type described above with reference to FIG. I and 2. As in the bandstop filter of FIG. 6, a respective varactor S is coupled between the lower end of each secondary resonator T2 and ground potential. Similarly, the upper end of each secondary resonator is coupled via a respective 100 kohm resistor R to a common point at which a control voltage $V_D$ may be applied. The upper ends of the adjacent main resonators are coupled via capacitors C3, C4. The input signal is coupled to the lefthand main resonator T1 by means of a transmission line strip L6, the upper end of which is coupled to a further transmission line strip L7. The strip L7 in turn provides coupling into the central resonator. Coupling from the righthand resonator for the signal output is provided again by an L-shaped pair of strips L8,L9 forming an orthogonal pair of transmission lines as in the bandstop embodiment of FIG. 6. The outer end of strip L9 is coupled directly to ground potential and the outer end of strip L8 is coupled to ground potential via a capacitor C5.

The characteristic curves representing the frequency response for this 3-pole bandpass filter as the applied voltage $V_D$ is varied are shown in FIG. 9, wherein the curves $J_1,J_2,J_3$ and $J_4$ correspond with a control voltage $V_D$ of 1V,2V,3V and 4V respectively.

Finally it is noted that other filter variants are possible within the scope of the claims. For example, in a multi-resonator filter not all of the main resonators but only selected resonators or groups of resonators may include secondary resonators in accordance with the invention.

I claim:

1. An adjustable resonator arrangement comprising:

a primary resonator operating at a primary resonant frequency, a secondary resonator capable of operating in one of two selectable resonant frequency states, said secondary resonator being disposed within an electromagnetic field of said primary resonator thus providing signal coupling therebetween wherein said secondary resonator first of said two selectable resonant frequency states is a resonant frequency sufficiently different from said primary resonant frequency of said primary resonator such that no effect is realized upon said primary resonator operating resonant frequency, and wherein said second of said two selectable frequency states is a frequency significantly and sufficiently nearer to said primary operating resonant frequency than said secondary resonator first resonant frequency to cause a change in said primary resonator frequency when said secondary resonator is operated at said second selectable resonant frequency state.

2. A main transmission line resonator device comprising:

a body of dielectric material having upper and lower surfaces, two side surfaces, two end surfaces and a hole with an interior surface, said hole extending from said upper surface to said lower surface, an electrically conductive layer covering major portions of said lower surface, one of said two side surfaces, both of said end surfaces and said interior surface of said hole, thereby forming said main transmission line resonator, an electrode pattern disposed upon one of said two side surfaces for providing an electrical—signal coupling to said main transmission line resonator and an electrically conductive strip disposed upon one of said two side surfaces of said main transmission line resonator device forming at least part of a transmission line secondary resonator, said secondary resonator having at least two selectable operative frequency states whereby in a first operative frequency state said secondary resonator operates at a first resonant frequency sufficiently different from said main transmission line resonator operative frequency so as not to have any effect thereon, and in a second resonant frequency state said secondary resonator operates at a second resonant frequency sufficiently close to said main transmission line resonator operative frequency to effectively change said main transmission line resonator operative frequency.

3. An adjustable resonator arrangement as claimed in claim 1, wherein the first resonant frequency of the secondary resonator is substantially different to the resonant frequency of the primary resonator and thereby has no appreciable affect thereon.

4. An adjustable resonator arrangement as claimed in claim 1 or claim 2, wherein the secondary resonator includes adjustment means for selecting the two states thereof, and means for applying a control signal to said adjustment means, wherein the state of said secondary resonator is determined by the adjustment means in response to the control signal applied thereto.

5. An adjustable resonator arrangement as claimed in claim 4, wherein the control signal applying means comprise means for applying a control voltage.

6. An adjustable resonator arrangement as claimed in claim 4, wherein the adjustment means comprise a diode.

7. An adjustable resonator arrangement as claimed in claim 6, wherein the adjustment means comprise a varactor.

8. An adjustable resonator arrangement as claimed in claim 1, wherein in one state the secondary resonator corresponds to a half-wave resonator, and in another state the secondary resonator corresponds to a quarter-wave resonator.

9. An adjustable resonator arrangement as claimed in claim 8, wherein the resonant frequency of the primary resonator is lowered when the secondary resonator is in the state corresponding to a quarter-wave resonator.

10. An adjustable resonator arrangement as claimed in claim 1, wherein the secondary resonator includes a transmission line comprising a conductive strip.

11. An adjustable resonator arrangement as claimed in claim 10, wherein the secondary resonator includes a first transmission line comprising a first conductive strip and a second transmission line comprising a second conductive strip, the first and second conductive strips being intercoupled by switching means.

12. A tunable filter comprising a plurality of resonator means, wherein at least one of said resonator means comprises an adjustable resonator arrangement as claimed in claim 1 the filter having a center frequency dependant on the selected states of said at least one resonator.

13. A tunable filter comprising a plurality of resonator means, wherein at least two of said resonator means comprise a respective individually adjustable resonator arrangement as claimed in claim 1, the filter having a center frequency dependant on the selected states of said at least two resonator means.

14. A tunable filter comprising a plurality of resonator means, wherein each of said resonator means comprises a respective individually adjustable resonator arrangement as claimed in claim 1, the filter having a center frequency dependant on the selected states of said resonator means.

15. A resonator device as claimed in claim 2 further comprising means for adjusting the resonant frequency of the secondary transmission line resonator.

16. A resonator device as claimed in claim 15 wherein the adjusting means is provided on said other side surface of the dielectric body and is electrically connected between the conductive strip forming the secondary resonator and a further conductive strip provided on said other side surface, the further conductive strip being connected to the conductive layer on the dielectric body.

17. A resonator device as claimed in either of claims 15 or 16, wherein in a first state determined by the adjusting means the end of the conductive strip forming the secondary transmission line resonator to which the adjusting means is coupled is short-circuited to the conductive layer on the dielectric body, and in a second state determined by the adjusting means the end of the conductive strip forming the secondary transmission line resonator to which the adjusting means is coupled is substantially electrically isolated from the conductive layer on the dielectric body.

18. A resonator device as claimed in claim 17, wherein the end of the conductive strip forming the secondary transmission line resonator opposite the end to which the adjusting means is coupled is electrically open-circuited.

19. A resonator device as claimed in claim 17, wherein the end of the conductive strip forming the secondary transmission line resonator opposite the end to which the adjusting means is coupled is reactively coupled to the conductive layer on the dielectric body.

20. A resonator device as claimed in claim 2, wherein the adjusting means comprises a diode.

21. A filter comprising a plurality of resonator means, at least one of said resonator means comprising a resonator device as claimed in claim 2.

22. A filter as claimed in claim 21, wherein each of said resonator means comprises a resonator device as claimed in any of the preceding claims.

23. A filter as claimed in claim 21 or claim 22 wherein each of the resonator means is formed respectively from a discrete body of dielectric material.

24. A filter as claimed in claim 21 or claim 22, wherein two or more of the resonator means are formed from a common body of dielectric material.

25. A filter as claimed in claim 24, wherein all of the resonator means are formed from a common body of dielectric material.

26. A bandstop filter comprising a plurality of predominantly inductively coupled resonator means, at least one of said resonator means comprising an adjustable resonator arrangement as claimed in claim 1.

27. A bandstop filter comprising a plurality of predominantly inductively coupled resonator means, at least one of said resonator means being in accordance with the resonator device claimed in claim 2.

28. A bandpass filter comprising a plurality of predominantly capacitively coupled resonator means, at least one of said resonator means comprising an adjustable resonator arrangement as claimed in claim 1.

29. A bandpass filter comprising a plurality of predominantly capacitively coupled resonator means, at least one of said resonator means being in accordance with the resonator device claimed in claim 2.

* * * * *